United States Patent [19]

Janssens et al.

[11] 4,353,975

[45] Oct. 12, 1982

[54] DYE-DIFFUSION TRANSFER PROCESS

[75] Inventors: Wilhelmus Janssens, Aarschot; Daniël A. Claeys, Mortsel, both of Belgium

[73] Assignee: Agfa-Gevaert, N.V., Mortsel, Belgium

[21] Appl. No.: 292,248

[22] Filed: Aug. 12, 1981

[30] Foreign Application Priority Data

Sep. 30, 1980 [GB] United Kingdom ..... 8031433

[51] Int. Cl.[3] ..... G03C 1/40; G03C 1/10; G03C 5/54

[52] U.S. Cl. ..... 430/239; 430/218; 430/223; 430/242; 430/48

[58] Field of Search ..... 430/218, 223, 239, 242, 430/487

[56] References Cited

U.S. PATENT DOCUMENTS

| | | | |
|---|---|---|---|
| 4,030,920 | 6/1977 | Kuh et al. | 430/227 |
| 4,139,379 | 2/1979 | Chasman et al. | 430/223 |
| 4,232,107 | 11/1980 | Janssens et al. | 430/218 |

*Primary Examiner*—Richard L. Schilling
*Attorney, Agent, or Firm*—A. W. Breiner

[57] ABSTRACT

A dye-diffusion transfer process for producing (a) dye image(s) with improved dye density is provided, said process comprising the steps of:

(1) image-wise photo-exposing a photographic color material, which contains at least one alkali-permeable silver halide hydrophilic colloid layer which contains in operative contact therewith or therein a non-diffusing dye or dye precursor compound that when contacted with an aqueous alkaline liquid remains immobile in an alkali-permeable colloid layer and is capable of being reduced by a silver halide developing agent at a rate slower than that of imagewise developable silver halide and in reduced state under alkaline conditions is capable of releasing a diffusible dye or dye precursor moiety, and (2) applying in the presence of a developing agent an aqueous alkaline liquid to said photoexposed material, characterized in that said liquid contains triisopropanolamine.

11 Claims, No Drawings

DYE-DIFFUSION TRANSFER PROCESS

The present invention relates to an improved dye-diffusion transfer process using a photosensitive silver halide material.

Dye-diffusion transfer systems for the production of multicolour dye images operate with photosensitive silver halide materials and can be carried out in a number of ways. They are all based on the same principle, viz. the alteration in the mobility of a dye or a dye-forming structural part of a compound controlled by the image-wise development of the silver halide to silver.

According to a first system a diffusible dye is produced image-wise by reaction of a particular initially immobile image-dye-providing compound also called ballasted redox dye releaser with image-wise oxidized developing agent. Examples of such systems providing on development positive diffusion transfer dye images with an image-wise exposed direct-positive working silver halide emulsion material are described, e.g., in the U.K. Patent Specification No. 1,243,048 corresponding with the German Patent Specification No. 1,772,929, in the U.S. Pat. Nos. 3,227,550–3,628,952 and 4,030,920 and in the published U.S. Ser. No. B 351,673.

According to a second system a diffusible dye is produced image-wise by reaction of a particular initially immobile image-dye-providing compound with image-wise remaining non-oxidized developing agent. Examples of such systems providing positive diffusion transfer dye images with an image-wise exposed negative working silver halide emulsion material on development are described, e.g., in the U.S. Pat. Nos. 4,139,379 and 4,139,389, in the published European Patent Application No. 0 004 399 and in the European Patent Application No. 81 200303.6.

The image-dye providing compounds which for application in said second system obtain an increase in hydrolysability by reduction are so-called IHR-compounds, wherein IHR is the acronym for "Increased Hydrolysis by Reduction". The advantage of the use of such type of compounds lies in the possibility of producing positive colour images in combination with a negative-working emulsion whose composition is less sophisticated than that of internal image-positive-working silver halide emulsions and that can be manufactured with a much higher light-sensitivity than positive-working silver halide emulsions. Moreover, negative working silver halide emulsions develop much faster than positive-working silver halide emulsions which is an important advantage especially when applying in-camera-processing for instant picture photography.

According to U.S. Pat. No. 4,030,920 the dye-diffusion transfer process using internal-image silver halide emulsion layers having associated therewith a ballasted redox dye releaser yields colour images with improved dye densities when the processing proceeds with a processing composition containing a saturated, aliphatic or alicyclic glycol having from 3 to 10 carbon atoms or a saturated, aliphatic or alicyclic amino alcohol having from 2 to 10 carbon atoms.

We have found now that in a dye-diffusion transfer process using at least one silver halide emulsion layer having associated therewith a said IHR-compound, colour images with much higher dye densities are obtained with the particularly poorly water-soluble triisopropanolamine having the following structural formula: $N(CH_2—CHOH—CH_3)_3$ which compound has not been disclosed in the list of amino alcohols according to said U.S. Pat. No. 4,030,920.

Thus, in accordance with the present invention a process for the production of (a) dye image(s) by dye diffusion transfer is provided, comprising the steps of:

(1) image-wise photo-exposing a photographic colour material, which contains at least one alkali-permeable silver halide hydrophilic colloid layer which contains in operative contact therewith or therein a non-diffusing dye or dye precursor compound that when contacted with an aqueous alkaline liquid remains immobile in an alkali-permeable colloid layer of said material and is capable of being reduced by a silver halide developing agent at a rate slower than the reduction of image-wise developable silver halide of said silver halide hydrophilic colloid layer and in reduced state under alkaline conditions is capable of releasing a diffusible dye or dye precursor moiety and (2) applying an aqueous alkaline liquid to said photoexposed material effecting development in the presence of a developing agent and effecting with said liquid diffusion-transfer of said diffusible dye or dye precursor moiety to a receiving layer, characterized in that said liquid contains triisopropanolamine.

The term "non-diffusing" used herein has the meaning commonly applied to the term in photography and denotes materials that in any practical application do not migrate or wander through organic colloid layers, e.g. gelatin, when permeated with an aqueous alkaline liquid. The same meaning is to be attached to the term "immobile".

The term "diffusible" as applied to the materials of this invention has the converse meaning and denotes materials having the property of diffusing effectively through the colloid layers of the photographic elements when applying an aqueous alkaline liquid. "Mobile" has the same meaning.

By "operative contact" is meant that for producing diffusion transfer of an image-wise released dye or dye precursor compound on applying an alkaline processing liquid in the presence of a photographic silver halide developing agent, said compound releasing a dye or dye precursor can come into chemically reactive contact with unoxidized developing agent in an amount that is controlled by the image-wise developable silver halide of the image-wise photo-exposed silver halide emulsion layer. The quoted terms are sufficiently known to those skilled in the art.

Particularly suitable compounds releasing a dye or dye precursor for use according to the present invention are described in the U.S. Pat. Nos. 4,139,379 and 4,139,389, the published European Patent Application No. 0 004 399, and in the European Patent Application No. 81 200303.6, which documents have to be read in conjunction herewith.

An image-wise dye release by reaction with a developing agent acting as electron donor (ED-compound) proceeds e.g. according to the following reaction mechanism illustrated with simplified general formulae of quinonoid compounds (I):

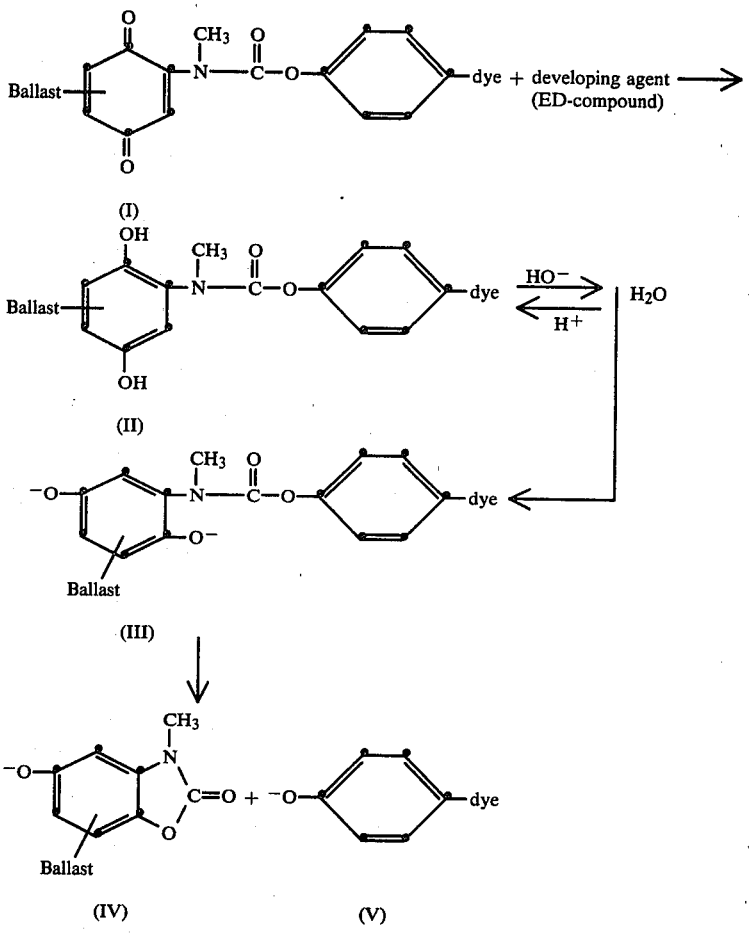

The dye compound (V) is released where the nucleophilic group, here the hydroxyl group of the hydroquinone, can attack the carbamate ester linkage. However, when the nucleophilic group is oxidized, which is the case in the quinone form, nucleophilic displacement is impossible. The compounds of the above formula (I) are referred to in said U.S. Pat. No. 4,139,379 as BEND-compounds wherein BEND is an acronym for Ballasted Electron-accepting Nucleophilic Displacement.

As is known in the art, "Ballast" stands for ballasting group, which group makes the molecule immobile. The ballasting group may be present as a substituent on the quinone nucleus. Thus, said BEND-compounds used according to the present invention are ballasted compounds capable of undergoing an electron-accepting nucleophilic displacement reaction separating hereby in alkaline medium a diffusible dye or dye precursor moiety.

Other particularly useful compounds releasing a dye or dye precursor in the process according to the present invention are described in the published European Patent Application No. 0 004 399. In the latter Application quinone-type or quinonoid compounds are described, which compounds by reduction yield hydroquinone type compounds that through the action of alkali ($HO^-$) are split into a ballasted quinone methide compound and a diffusible compound containing a dye moiety.

The image-wise dye release by reaction with a developing agent acting as electron donor (ED-compound) proceeds according to the following reaction mechanism illustrated with simplified general formulae of quinonoid compounds (I)[1]:

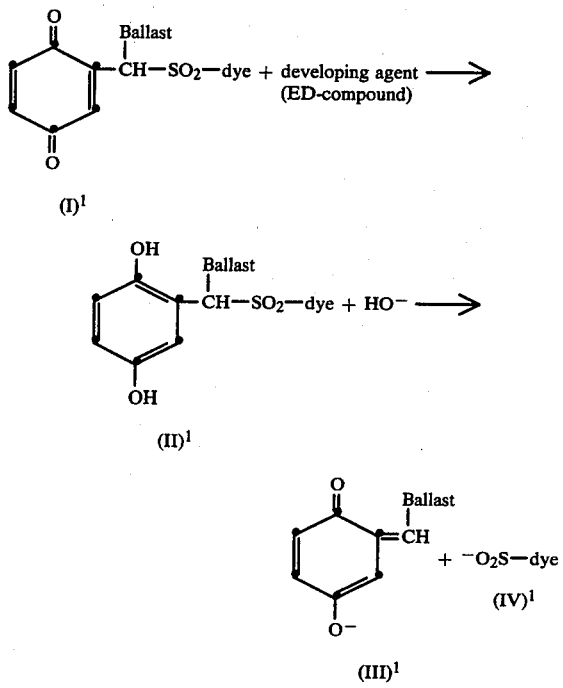

The above BEND compounds and quinone-methide-yielding compounds are IHR-compounds the hydrolysability of which is increased by reduction. The IHR-compounds applied in the present invention release in reduced state under alkaline conditions a diffusible dye or dye precursor moiety.

According to one embodiment of the present invention the above process is carried out with a photographic material containing at least two differently spectrally sensitized silver halide emulsion layers and a different IHR-compound in operative contact with each silver halide emulsion layer. The IHR-compound comprises a dye-providing moiety, which includes a dye, a shifted dye or a dye precursor such as an oxichromic compound or a colour coupler.

In a preferred embodiment the process of the present invention is carried out with a photographic multilayer, multicolour material, which comprises a layer containing a red-sensitive silver halide emulsion having in operative contact therewith an IHR-compound comprising a diffusible moiety providing a cyan image dye, a layer containing a green-sensitive silver halide emulsion having in operative contact therewith an IHR-compound comprising a diffusible moiety providing a magenta image dye, and a layer containing a blue-sensitive silver halide emulsion having in operative contact therewith an IHR-compound comprising a diffusible moiety providing a yellow image dye.

The moiety providing the image dye may be a preformed dye or a shifted dye. Dye materials of this type are well-known in the art and include azo dyes, azomethine (imine) dyes, anthraquinone dyes, alizarine dyes, merocyanine dyes, quinoline dyes, cyanine dyes and the like. As is known in the art, shifted dyes include those compounds whose light-absorption characteristics are shifted hypsochromically or bathochromically when subjected to a different environment such as a change in pH, a reaction with a material to form a complex, a tautomerization, reactions to change the pKa of the compound, a removal of a group such as a hydrolyzable acyl group connected to an atom of the chromophore as mentioned in Weyerts, U.S. Pat. No. 3,260,597, issued July 12, 1966, and the like. In certain embodiments the shifted dyes are highly preferred, especially those containing a hydrolyzable group on an atom affecting the chromophore resonance structure, since the compounds can be incorporated directly in a silver halide emulsion layer or even on the exposure side thereof without substantial reduction of the light that is effective in the exposure of the silver halide. After exposure the dye can be shifted to the appropriate colour such as, e.g., by hydrolytic removal of an acyl group to provide the respective image dye.

In another embodiment the compounds used in this invention contain an image dye-providing moiety, which is an image-dye precursor. The term "image-dye precursor" is understood to refer to those compounds that undergo reactions encountered in a photographic imaging system to produce an image dye such as colour couplers, oxichromic compounds, and the like.

When colour couplers are used they can be released in areas where no development occurs and can diffuse to an adjacent layer where they can be made to react with an oxidized colour developer such as an oxidized primary aromatic amine to form the image dye. Generally, the colour coupler and the colour developer are chosen so that the reaction product is immobile. Typical useful colour couplers include the pyrazolone couplers, pyrazolotriazole couplers, open-chain ketomethylene couplers, phenolic couplers and the like. Further reference to the description of appropriate couplers is found in U.S. Pat. No. 3,620,747 of John C. Marchant and Robert F. Motter, issued Nov. 16, 1971, which are incorporated herein by reference.

The compounds containing oxichromic moieties can be advantageously used in a photographic system since they are generally colourless materials because of the absence of an image-dye chromophore. Thus, they can be used directly in the photographic emulsion or on the exposure side thereof without competitive absorption. Compounds of this type are those compounds that undergo chromogenic oxidation to form the respective image dye. The oxidation can be carried out by aerial oxidation, incorporation of oxidants into the photographic element or film unit, or use of an oxidant during processing. Compounds of this type have been referred to in the art as leuco compounds, i.e. compounds that have no colour. Typical useful oxichromic compounds include leuco indoanilines, leuco indophenols, leuco anthraquinones and the like.

In the process of the present invention a silver halide developing agent is used that has sufficient reducing power to reduce photoexposed silver halide at a rate faster than in the reduction of the applied IHR compounds.

Photographic silver halide developing agents suitable for that purpose can be found by simple tests by using them in combination with an elected set of silver halide and IHR compound.

Typical useful silver halide developing agents applicable in the present invention include: hydroquinone compounds, 1-arylpyrazolidin-3-one compounds, pyrogallol and substituted pyrogallol compounds and ascorbic acid or mixtures thereof.

In a preferred embodiment the present process is carried out with a mixture of reducing agents one group of which is called electron donors (ED-compounds) and the other group is called electron-transfer agents (ETA-compounds). Generally, the electron-transfer agent is a compound that is a better silver halide reducing agent under the applied conditions of processing than the electron donor and, in those instances where the electron donor is incapable of, or substantially ineffective in developing the silver halide, the ETA-compound functions to develop the silver halide and provides a corresponding image-wise pattern of oxidized electron donor because the ETA-compound readily accepts electrons from the ED-compound.

The interlayer diffusion of the ED-compounds is effectively reduced by providing thereto a ballasting group so that they remain immobile in the layer unit wherein they have to transfer their electrons to the IHR compound associated therewith.

So, the ED-compound is preferably used in non-diffusible state in each silver halide emulsion layer containing a different non-diffusible dye or dye precursor. An example of such ED-compound is ascorbyl palmitate. Other examples can be found in U.S. Pat. No. 4,139,379 and in the published German Patent Application (DE-OS) No. 2947 425. The ETA-compound on the contrary is preferably used as developing agent in diffusible state and is, e.g., incorporated in mobile form in (a) hydrophilic colloid layer(s) adjacent to one or more silver halide emulsion layers.

In this way the reactions are better separated in their desired sequence in that first the image-wise oxidation of the ETA-compound by the exposed silver halide starts, then the rapid electron transfer of oxidized ETA-compound to the ED-compound takes place, which compound being the less reactive compound where unaffected finally reacts with the IHR compound to release the dye providing moiety.

The concentration of ED-compound in the photographic material may vary within a broad range but is, e.g. in the molar range of 1:2 to 4:1 with respect to the non-diffusing dye or dye precursor compound. The ETA-compound may be present in the alkaline developing liquid but is used preferably in diffusible form in non-photosensitive hydrophilic colloid layers adjacent to at least one silver halide emulsion layer. The concentration of the ETA-compound in the photographic material is preferably in the same molar range as wherein the ED-compound is applied.

Typically useful ETA-compounds include hydroquinone compounds such as hydroquinone, 2,5-dichlorohydroquinone, 2-chlorohydroquinone and the like; aminophenol compounds such as 4-aminophenol, N-methylaminophenol, 3-methyl-4-aminophenol, 3,5-dibromoaminophenol and the like; catechol compounds such as catechol, 4-cyclohexylcatechol, 3-methoxycatechol, 4-(N-octadecylamino)catechol and the like; phenylenediamine compounds such as N,N-diethyl-p-phenylenediamine, 3-methyl-N,N-diethyl-p-phenylenediamine, 3-methoxy-N-ethyl-ethoxy-p-phenylenediamine, N,N,N',N'-tetramethyl-p-phenylenediamine and the like. In highly preferred embodiments, the ETA is a 3-pyrazolidinone compound such as 1-phenyl-3-pyrazolidinone, 1-phenyl-4,4-dimethyl-3-pyrazolidinone, 4-hydroxymethyl-4-methyl-1-phenyl-3-pyrazolidinone, 1-m-tolyl-3-pyrazolidinone, 1-p-tolyl-3-pyrazolidinone, 1-phenyl-4-methyl-3-pyrazolidinone, 1-phenyl-5-methyl-3-pyrazolidinone, 1-phenyl-4,4-bis-(hydroxymethyl)-3-pyrazolidinone, 1,4-dimethyl-3-pyrazolidinone, 4-methyl-3-pyrazolidinone, 4,4-dimethyl-3-pyrazolidinone, 1-(3-chlorophenyl)-4-methyl-3-pyrazolidinone, 1-(4-chlorophenyl)-4-methyl-3-pyrazolidinone, 1-(3-chlorophenyl)-3-pyrazolidinone, 1-(4-chlorophenyl)-3-pyrazolidinone, 1-(4-tolyl)-4-methyl-3-pyrazolidinone, 1-(2-tolyl)-4-methyl-3-pyrazolidinone, 1-(4-tolyl)-3-pyrazolidinone, 1-(3-tolyl)-3-pyrazolidinone, 1-(3-tolyl)-4,4-dimethyl-3-pyrazolidinone, 1-(2-trifluoroethyl)-4,4-dimethyl-3-pyrazolidinone, 5-methyl-3-pyrazolidinone and the like. A combination of different ETA's such as those disclosed in U.S. Pat. No. 3,039,869 can be employed likewise. Such developing agents can be employed in the liquid processing composition or may be contained, at least in part, in any layer or layers of the photographic element or film unit such as the silver halide emulsion layers, the dye image-providing material layers, interlayers, image-receiving layer, etc. The particular ETA selected will, of course, depend on the particular electron donor and IHR compound used in the process and the processing conditions for the particular photographic element.

A preferred multicolour photographic material for use in the present invention with a separate image-receiving material contains a support, which is coated in successive order with (1) a red-sensitive silver halide emulsion layer containing a non-diffusing dye compound comprising a diffusible moiety providing a cyan image dye and a non-diffusing ED-compound,
(2) a hydrophilic colloid interlayer, e.g. gelatin layer, containing a diffusible ETA-compound,
(3) a green-sensitive silver halide emulsion layer containing a non-diffusing dye compound comprising a diffusible moiety providing a magenta image dye and a non-diffusing ED-compound,
(4) a hydrophilic colloid interlayer, e.g. gelatin layer, containing a diffusible ETA-compound,
(5) a blue-sensitive silver halide emulsion layer containing a non-diffusing dye compound comprising a diffusible moiety providing a yellow image dye and a non-diffusing ED-compound, and
(6) a protective hydrophilic colloid layer, e.g. gelatin layer, containing a diffusible ETA-compound.

The ED-compound is, e.g., ascorbyl palmitate corresponding to the following structural formula:

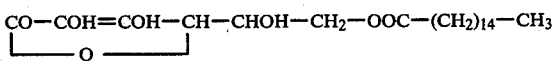

and the ETA-compound is e.g. 1-phenyl-3-pyrazolidinone.

Migration of non-oxidized developing agent, e.g. acting as ETA-compound, proceeds non-image-wise and will have an adverse effect on correct colour rendering when surplus developing agent remains or arrives in the photo-exposed area of a negative working emulsion layer.

In order to remedy for said defect it has been proposed in the copending GB-Application filed on even date herewith and entitled: "Process for the production of a multicolour image by image-wise dye diffusion transfer" to use a silver halide solvent for mobilizing unexposed silver halide in complexed form for helping to neutralize (i.e. oxidize by physical development) migrated developing agent in the photoexposed area wherein unaffected developing agent (ETA compound) should no longer be available for reacting with the IHR compound directly or through the applied ED-compound.

The more extensive developer exhaustion that takes place with the transferred silver complex in the photoexposed areas prevents dye release from the photoexposed areas so that dye images with higher colour saturation, i.e. more bright colour images, are obtained.

A considerable number of compounds forming alkali-soluble complexes with silver ions are known to those skilled in the art of silver halide photography. Among the many silver halide solvents may be mentioned thiosulphates, thiocyanates, thiosugars, thioether acids e.g. $HOOC—(CH_2—S—CH_2)_3—COOH$ or an active methylene compound having the methylene group linked directly to sulphonyl groups e.g. $H_3C—SO_2—CH_2—SO_2—CH_3$. Preferably used are, however, water-soluble thiosulphates (particularly alkali metal thiosulphate or ammonium thiosulphate).

According to one embodiment the silver halide solvent acting as silver-ion-complexing agent is applied in the aqueous alkaline liquid that is used in the development step and contains the triisopropanolamine. A useful concentration of silver halide solvent, e.g. sodium thiosulphate, in said liquid is in the range of 0.1 g to 40 g per liter. A useful concentration of triisopropanolamine (in said aqueous alkaline liquid) is in the range of 10 to 120 g per liter, preferably 40 to 80 ml per liter.

The photosensitive silver halide present in a multilayer multicolour silver halide photographic material used in the process of the present invention is e.g. a silver halide of the group of silver chloride, silver bromide, silver bromoiodide, silver chlorobromoiodide and the like, or mixtures thereof. The emulsions may be coarse- or fine-grain and can be prepared by any of the well-known procedures, e.g., single-jet emulsions, double-jet emulsions. They may be Lippmann emulsions, ammoniacal emulsions, thiocyanate- or thioether-ripened emulsions such as those described in U.S. Pat. No. 2,222,264 of Adolph H. Nietz and Frederick J. Russell, issued Nov. 19, 1940, 3,320,069 of Bernard D. Illingsworth, issued May 16, 1967, and U.S. Pat. No. 3,271,157 of Clarence E. McBride, issued Sept. 6, 1966. Surface-image emulsions or internal-image emulsions may be used such as those described in U.S. Pat. No. 2,592,250 of Edward Philip Davey and Edward Bowes Knott, issued Apr. 8, 1952, U.S. Pat. No. 3,206,313 of Henry D. Porter, Thomas H. James and Wesley G. Lowe, issued Sept. 14, 1965, and U.S. Pat. No. 3,447,927 of Robert E. Bacon and Jean F. Barbier, issued June 3, 1969. The emulsions may be regular-grain in J.Photogr.Sci., Vol. 12, No. 5, September/October, 1964, pp. 242–251. If desired, mixtures of surface- and internal-image emulsions may be used as described in U.S. Pat. No. 2,996,382 of George W. Luckey and John C. Hoppe, issued Aug. 15, 1961.

As already indicated negative working silver halide emulsions are preferably used but the use of the IHR-compounds is not restricted thereto.

Suitable negative-type or direct-positive emulsions are e.g. those described in U.S. Pat. No. 2,184,013 of John L. Leermakers, issued Dec. 19, 1939, U.S. Pat. No. 2,541,472 of William B. Kendall and George D. Hill, issued Feb. 13, 1951, U.S. Pat. No. 3,367,778 of Robert W. Berriman, issued Feb. 6, 1968, U.S. Pat. No. 3,501,307 of Bernard D. Illingsworth, issued Mar. 17, 1970, U.S. Pat. No. 2,563,785 of Charles F. Ives, issued Aug. 7, 1951, U.S. Pat. No. 2,456,953 of Edward Bowes Knott and Guy William Willis, issued Dec. 21, 1948, U.S. Pat. No. 2,861,885 of Edwin H. Land, issued Nov. 26, 1958, U.S. Pat. No. 3,761,276 of Francis John Evans, issued Sept. 25, 1973, U.S. Pat. No. 3,761,266 of Kirby Mitchell Milton, issued Sept. 25, 1973, U.S. Pat. No. 3,736,140 of Susan Starr Collier and Paul Brewster Gilman Jr., issued May 29, 1973, and U.S. Pat. No. 3,730,723 of Paul Brewster Gilman Jr., Ronald George Raleigh and Thaddeus Donald Koszelak, issued May 1, 1973, and U.K. Patent Specification No. 723,019 filed Feb. 5, 1952 by Gevaert Photo-Producten N.V.

These silver halide emulsions are well-known to those skilled in the art. More details about their composition, preparation and coating are described, e.g. in Product Licensing Index, Vol. 92, December 1971, publication 9232, p. 107–109.

Generally speaking, the silver halide emulsion layers used in the invention comprise photosensitive silver halide dispersed in gelatin and are about 0.2 to 2 μm thick. Preferably the dye image-providing materials are dispersed therein.

The support for the photographic elements for use in this invention may be any material as long as it does not deleteriously affect the photographic properties of the film unit and is dimensionally stable. Typical flexible sheet materials are paper supports, e.g. coated at one or both sides with an α-olefin polymer, e.g. polyethylene, or film supports e.g. cellulose nitrate film, cellulose acetate film, poly(vinyl acetal) film, polystyrene film, poly(ethylene terephthalate) film, polycarbonate film, poly-α-olefins such as polyethylene and polypropylene film, and related films of resinous materials. The support is usually about 0.05 to 0.15 mm thick.

In a photographic material for use according to the invention and containing two or more silver halide emulsion layers, each silver halide emulsion layer containing a dye image-providing material or having the dye image-providing material present in a contiguous layer is preferably separated from the other silver halide emulsion layer(s) in the film unit by (an) interlayer(s), including e.g. gelatin, calcium alginate, or any of the colloids disclosed in U.S. Pat. No. 3,384,483 of Richard W. Becker, issued May 21, 1968, polymeric materials such as polyvinylamides as disclosed in U.S. Pat. No. 3,421,892 of Lloyd D. Taylor, issued Jan. 14, 1969, or any of those disclosed in French Patent Specification No. 2,028,236 filed Jan. 13, 1970 by Polaroid Corporation or U.S. Pat. No. 2,992,104 of Howard C. Haas, issued July 11, 1961 and U.S. Pat. No. 3,427,158 of David P. Carlson and Jerome L. Reid, issued Feb. 11, 1969.

The interlayers are permeable to alkaline solutions, and are about 1 to 5 μm thick. Of course these thicknesses are approximate only and may be modified according to the product desired.

According to an embodiment for more correct colour rendition in the preparation of a multicolour dye diffusion transfer material for use according to the present invention, a water-permeable colloid interlayer dyed with a non-diffusing yellow dye is applied below the blue-sensitive silver halide emulsion layer containing a yellow dye-releasing compound, and a water-permeable colloid interlayer dyed with a non-diffusing magenta dye is applied below the green-sensitive silver halide emulsion layer containing a magenta dye-releasing compound.

The image-receiving material used in this invention has the desired function of mordanting or otherwise fixing the dye images transferred from the photosensitive element. The particular material chosen will, of course, depend upon the dye to be mordanted. If acid dyes are to be mordanted, the image-receiving layer can be composed of, or contain basic polymeric mordants such as polymers of aminoguanidine derivatives of vinyl methyl ketone such as described in U.S. Pat. No. 2,882,156 of Louis M. Minsk, issued Apr. 14, 1959, and basic polymeric mordants and derivatives, e.g. poly-4-vinylpyridine, the 2-vinylpyridine polymer metho-p-toluene sulphonate and similar compounds described in U.S. Pat. No. 2,484,430 of Robert H. Sprague and Leslie G. Brooker, issued Oct. 11, 1949, the compounds described in the published German Patent Application No. 2,200,063 filed Jan. 11, 1971 by Agfa-Gevaert A. G. Suitable mordanting binders include, e.g. guanylhydrazone derivatives of acyl styrene polymers, as described, e.g., in published German Patent Specification No. 2,009,498 filed Feb. 28, 1970 by Agfa-Gevaert A. G. In general, however, other binders, e.g. gelatin, would be added to the last-mentioned mordanting binders. Effective mordanting compositions are long-chain quaternary ammonium or phosphonium compounds or ternary sulphonium compounds, e.g. those described in U.S. Pat. No. 3,271,147 of Walter M. Bush and U.S. Pat. No. 3,271,148 of Keith E. Whitmore, both issued Sept. 6, 1966, and cetyltrimethyl-ammonium bromide. Certain metal salts and their hydroxides that form sparingly soluble compounds with the acid dyes may be used too. The dye mordants are dispersed in one of the usual hydrophilic binders in the image-receiving layer, e.g. in gelatin, polyvinylpyrrolidone or partly or completely hydrolysed cellulose esters.

Generally, good results are obtained when the image-receiving layer, which is preferably permeable to alkaline solutions, is transparent and about 4 to about 10 μm thick. This thickness, of course, can be modified depending upon the result desired. The image-receiving layer may also contain ultraviolet-absorbing materials to protect the mordanted dye images from fading, brightening agents such as the stilbenes, coumarins, triazines, oxazoles, dye stabilizers such as the chromanols, alkylphenols, etc.

According to a particular embodiment the photosensitive material is modified for in-camera-processing. For that purpose the photosensitive silver halide emulsion layers are normally negative-working and applied to the same support as the receptor layer so as to form an integral combination of light-sensitive layer(s) and a non light-sensitive layer receiver element preferably with an opaque layer, which is alkali-permeable, reflective to light and located between the receptor layer and the silver halide emulsion layer(s). In a process using such material the alkaline processing composition may be applied between the outer photosensitive layer of the photographic element and a cover sheet, which may be transparent and superposed before exposure.

To form the opaque layer an opacifying agent can be applied from a processing composition. Examples of opacifying agents include carbon black, barium sulphate, zinc oxide, barium stearate, silicates, alumina, zirconium oxide, zirconium acetyl acetate, sodium zirconium sulphate, kaolin, mica, titanium dioxide, organic dyes such as indicator dyes, nigrosines, or mixtures thereof in widely varying amounts depending upon the degree of opacity desired. In general, the concentration of opacifying agent should be sufficient to prevent further exposure of the film unit's silver halide emulsion or emulsions by ambient actinic radiation through the layer of processing composition, either by direct exposure through a support or by light piping from the edge of the element. For example, carbon black or titanium dioxide will generally provide sufficient opacity when they are present in the processing solution in an amount of from about 5 to 40% by weight. After the processing solution and opacifying agent have been distributed into the film unit, processing may take place out of the camera in the presence of actinic radiation in view of the fact that the silver halide emulsion(s) of the laminate is (are) appropriately protected against incident radiation, at one major surface by the opaque processing composition and at the remaining major surface by the opaque layer that is permeable to alkaline solutions. In certain embodiments, ballasted indicator dyes or dye precursors can be incorporated in a layer on the exposure side of the photosensitive layers; the indicator dye is preferably transparent during exposure and becomes opaque when contacted with the processing composition. Opaque binding tapes can also be used to prevent edge leakage of actinic radiation incident on the silver halide emulsion.

When titanium dioxide or other white pigments are employed as the opacifying agent in the processing composition, it may also be desirable to employ in cooperative relationship therewith a pH-sensitive opacifying dye such as a phthalein dye. Such dyes are light-absorbing or coloured at the pH at which image formation is effected and colourless or not light-absorbing at a lower pH. Other details concerning these opacifying dyes are described in French Patent Specification No. 2,026,927 filed Dec. 22, 1969 by Polaroid Corporation.

The substantially opaque, light-reflective layer, which is permeable to alkaline solutions, in the receiver part of integral film units suited for use in the present invention can generally comprise any opacifier dispersed in a binder as long as it has the desired properties. Particularly desirable are white light-reflective layers since they would be esthetically pleasing backgrounds on which to view a transferred dye image and would also possess the optical properties desired for reflection of incident radiation. Suitable opacifying agents include, as already mentioned with respect to the processing composition, titanium dioxide, barium sulphate, zinc oxide, barium stearate, silver flake, silicates, alumina, zirconium oxide, zirconium acetyl acetate, sodium zirconium sulphate, kaolin, mica, or mixtures thereof in widely varying amounts depending upon the degree of opacity desired. The opacifying agents may be dispersed in any binder such as an alkaline solution-permeable polymeric matrix such as, for example, gelatin, polyvinyl alcohol, and the like. Brightening agents such as the stilbenes, coumarins, triazines and oxazoles may also be added to the light-reflective layer, if desired. When it is desired to increase the opacifying capacity of the light-reflective layer, dark-coloured opacifying agents may be added to it, e.g., carbon black, nigrosine dyes, etc. Another technique to increase the opacifying capacity of the light-reflective layer is to employ a separate opaque layer underneath it comprising, e.g., carbon black, nigrosine dyes, etc., dispersed in a polymeric matrix that is permeable to alkaline solutions such as, e.g., gelatin, polyvinyl alcohol, and the like. Such an opaque layer should generally have a density of at least 4 and preferably greater than 7 and should be substantially opaque to actinic radiation. The opaque layer may also be combined with a developer scavenger layer if one is present. The light-reflective and opaque layers are generally 0.025 to 0.15 mm in thickness, although they can be varied depending upon the opacifying agent employed, the degree of opacity desired, etc.

Use of pH-lowering material in the dye-image-receiving element of an integral film unit for use according to the invention usually increase the stability of the transferred image. Generally, the pH-lowering material will effect a reduction of the pH of the image layer from about 13 or 14 to at least 11 and preferably 5–8 within a short time after imbibition. For example, polymeric acids as disclosed in U.S. Pat. No. 3,362,819 of Edwin H. Land, issued Jan. 9, 1968 or solid acids or metallic salts, e.g. zinc acetate, zinc sulphate, magnesium acetate, etc., as disclosed in U.S. Pat. No. 2,584,030 to Edwin H. Land, issued Jan. 29, 1952, may be employed with good results. Such pH-lowering materials reduce the pH of the film unit after development to terminate development and substantially reduce further dye transfer and thus stabilize the dye image.

An inert timing or spacer layer may be employed in practive over the pH-lowering layer, which "times" or controls the pH reduction depending on the rate at which alkali diffuses through the inert spacer layer. Examples of such timing layers include gelatin, polyvinyl alcohol or any of the colloids disclosed in U.S. Pat. No. 3,455,686 of Leonard C. Farney, Howard G. Rogers and Richard W. Young, issued July 15, 1969. The timing layer may be effective in evening out the various reaction rates over a wide range of temperatures, e.g., premature pH reduction is prevented when imbibition is effected at temperatures above room temperature, e.g. at 35° to 37° C. The timing layer is usually about 2.5 μm to about 18 μm thick. Especially good results are obtained when the timing layer comprises a hydrolysable polymer or a mixture of such polymers that are slowly hydrolysed by the processing composition. Examples of such hydrolysable polymers include polyvinyl acetate, polyamides and cellulose esters.

The alkaline processing composition used in this invention may contain a conventional alkaline material, e.g. sodium hydroxide, sodium carbonate or in addition to the presently used triisopropanolamine an other amine such as diethylamine. Preferably the pH of the processing composition is at least 11. The processing composition contains the triisopropanolamine and preferably also the above defined silver halide solvent.

According to one embodiment the alkaline processing liquid contains the diffusible developing agent e.g. serving as ETA-compound that effects the reduction of the exposed and complexed silver halide, e.g. ascorbic acid or a 3-pyrazolidinone developing agent such as 1-phenyl-4-methyl-3-pyrazolidinone.

The alkaline processing composition employed in this invention may also contain a desensitizing agent such as methylene blue, nitro-substituted heterocyclic compounds, 4,4'-bipyridinium salts, etc., to insure that the photosensitive element is not further exposed after it is removed from the camera for processing.

The solution also preferably contains a viscosity-increasing compound such as a high-molecular-weight polymer, e.g. a water-soluble ether inert to alkaline solutions such as hydroxyethylcellulose or alkali metal salts of carboxymethylcellulose such as sodium carboxymethylcellulose. A concentration of viscosity-increasing compound of about 1 to about 5% by weight of the processing composition is preferred. It will impart thereto a viscosity of about 100 mPa.s to about 200,000 mPa.s.

In an embodiment wherein said photographic colour material is used in conjunction with a receiving material separatable from the photographic material e.g. for colour proofing the development may proceed in a tray developing unit as is present, e.g. in an ordinary silver complex diffusion transfer (DTR) apparatus in which contacting with the separate dye image-receiving material is effected after a sufficient absorption of processing liquid by the photographic material has taken place. A suitable apparatus for said purpose is the COPYPROOF CP 38 (trade name) DTR-developing apparatus. COPYPROOF is a trade name of Agfa-Gevaert, Antwerp/Leverkusen.

According to an other embodiment a photographic material suitable for use in in-camera-processing is provided wherein the receiving layer is integral with the photographic material and is arranged in water-permeable relationship with the silver halide hydrophilic colloid layer(s). The processing liquid is applied e.g. from a rupturable container making part of the material or by spraying.

The rupturable container may be of the type disclosed in U.S. Pat. No. 2,543,181 of Edwin H. Land, issued Feb. 27, 1951, U.S. Pat. No. 2,643,886 of Ulrich L. di Ghilini, issued June 30, 1953, U.S. Pat. No. 2,653,732 to Edwin H. Land, issued Sept. 29, 1953, U.S. Pat. No. 2,723,051 of William J. McCune Jr., issued Nov. 8, 1955, U.S. Pat. Nos. 3,056,492 and 3,056,491, both of John E. Campbell, issued Oct. 2, 1962, and U.S. Pat. No. 3,152,515 to Edwin H. Land, issued Oct. 13, 1964. In general such containers comprise a rectangular sheet of fluid- and air-impervious material folded longitudinally upon itself to form two walls that are sealed to one another along their longitudinal and end margins to form a cavity in which processing solution is contained.

While the alkaline processing composition used in this invention can be employed in a rupturable container, as described previously, to facilitate conveniently the introduction of processing composition into the film unit, other means of discharging processing composition within the film unit could also be employed, e.g., means injecting processing solution with communicating members similar to hypodermic syringes, which are attached either to a camera or camera cartridge, as described in U.S. Pat. No. 3,352,674 of Donald M. Harvey, issued Nov. 14, 1967.

The main aspect of the present invention is the use of triisopropanolamine in a diffusion transfer process operating with IHR type compounds from which by reduction and in alkaline medium a dye is released as photographically useful fragment. This is the reason why mainly reference is made to colour providing compounds. The invention, however, is not at all limited to this aspect and it should be kept in mind that for various other purposes other photographically useful fragments may be present in these IHR compounds instead of dyes or dye precursors.

The following comparative examples further illustrate the invention. All percentages and ratios are by weight, unless otherwise mentioned.

EXAMPLE 1

A subbed water-resistant paper support consisting of a paper sheet of 110 g/sq.m coated at both sides with a polyethylene stratum of 15 g/sq.m was treated with a corona discharge and thereupon coated in the mentioned order with the following layers:

| | | |
|---|---|---|
| (1) | an alkali-permeable colloid layer containing after drying per sq. m: | |
| | gelatin | 1.5 g |
| | cyan dye-providing quinonoid compound $C_1$ (applied from a dispersion prepared as described hereinafter) | 0.25 g |
| | silver chloride (applied from a red-sensitized gelatin-silver chloride emulsion) | 0.498 g |
| | 2,5-bis(1',1',3',3'-tetramethylbutyl)-hydroquinone | 0.055 g |
| (2) | an interlayer containing per sq. m: | |
| | gelatin | 1.155 g |
| | 1-phenyl-4-methyl-3-pyrazolidinone (added from a dispersion prepared as described hereinafter) | 0.084 g |
| | 2-acetyl-5-octadecyl (2)-hydroquinone | 0.096 g |
| | as magenta filtering dye Pigment Red 146 (C.I. 11,000) | 0.910 g |
| (3) | an alkali-permeable colloid layer containing per sq. m: | |
| | gelatin | 1.285 g |
| | magenta dye-providing quinonoid compound $M_1$ (applied from a dispersion prepared as described hereinafter) | 0.228 g |
| | 2,5-bis(1',1',3',3'-tetramethylbutyl)-hydroquinone | 0.055 g |
| | silver chloride (applied from a green-sensitized gelatin-silver chloride emulsion) | 0.553 g |
| (4) | an interlayer containing per sq. m: | |

-continued

| | | |
|---|---|---|
| | gelatin | 1.155 g |
| | 1-phenyl-4-methyl-3-pyrazolidinone | 0.084 g |
| | 2-acetyl-5-octadecyl(2)-hydroquinone | 0.096 g |
| | as yellow filtering dye Pigment Yellow 83 (C.I. 20,000) | 1.085 g |
| (5) | an alkali-permeable colloid layer containing per sq. m: | |
| | gelatin | 2.046 g |
| | yellow dye-providing quinonoid compound $Y_1$ (applied from a dispersion as described hereinafter) | 0.485 g |
| | ascorbyl palmitate (added from a dispersion prepared as described hereinafter) | 0.232 g |
| | silver chloride (applied from a blue-sensitive gelatin-silver chloride emulsion) | 0.500 g |
| (6) | a protective layer containing per sq. m: | |
| | gelatin | 1.50 g |
| | 1-phenyl-4-methyl-3-pyrazolidinone | 0.112 g |
| | Preparation of the dispersion of 1-phenyl-4-methyl-3-pyrazolidinone | |

The preparation proceeded by sand-milling the following ingredients:

| | |
|---|---|
| gelatin | 40 G |
| 1-phenyl-4-methyl-3-pyrazolidinone | |
| 40% aqueous solution of LOMAR D (trade name) | 10 ml |
| distilled water | 850 ml |
| (LOMAR D is a trade name of Nopco Chemical Company, Newark, N.J., U.S.A. for a naphthalene sulphonate condensate, formaldehyde being used in the condensation reaction). | |

Preparation of the dispersion of ascorbyl palmitate 50 g of ascorbyl palmitate were first dissolved in 450 ml of ethanol forming solution A.

A solution of 125 g of gelatin in 1975 ml of distilled water was prepared and added to a solution containing 4.8 g of sodium hydroxide, 0.2 ml of n-octylalcohol and 95 ml of distilled water so as to form solution B. Thereupon solution A was thoroughly mixed with solution B.

Preparation of the dispersion of yellow dye-providing compound $Y_1$

The preparation proceeded by sand-milling and using the following ingredients: compound $Y_1$ prepared as described hereinafter and in the European Patent Application No. 81 200303.6 as compound VII and having the following structural formula:

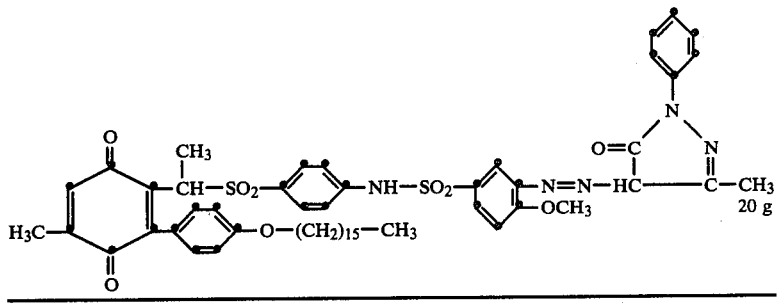

| | |
|---|---|
| gelatin | 50 g |
| N—methyl-pyrrolidinone | 20 g |
| 10% aqueous solution of MARLON A-396 (trade name) | 20 ml |
| distilled water | 625 g |

Compound $Y_1$ was first dissolved in ethylacetate and added whilst vigorously stirring to the gelatin dissolved in the indicated amount of water. Thereupon the ethylacetate was removed by evaporation under reduced pressure.

MARLON A-396 is a trade name of Chemische Werke Hüls AG Marl/Westfalen, W. Germany for a wetting agent having the formula:

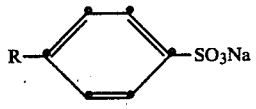

wherein R is $C_{10}$–$C_{13}$ n-alkyl.

Preparation of the dispersion of magenta dye-providing compound $M_1$.

The preparation proceeded analogously to the preparation of the dispersion of compound $Y_1$ but wherein the following ingredients were used: compound $M_1$ prepared as described hereinafter and in the European Patent Application No. 81 200303.6 as compound VI and having the following structural formula:

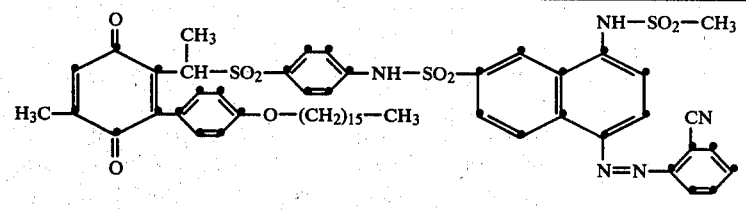

10 g

| | |
|---|---|
| gelatin | 25 g |
| 10% aqueous solution of MARLON A-396 (trade name) | 10 ml |
| distilled water | 1000 g |

Preparation of the dispersion of cyan dye-providing compound $C_1$

The preparation proceeded analogously to the preparation of the dispersion of compound $Y_1$ but wherein the following ingredients were used: compound $C_1$ prepared analogously to the quinone derivative of compound 39 of published European Patent Application 0 004 399 and having the following structural formula:

-continued

| | |
|---|---|
| distilled water up to | 1000 ml |

Composition of the receptor material

To the same support as described for the above light-sensitive material a coating having the following composition was applied per sq.m:

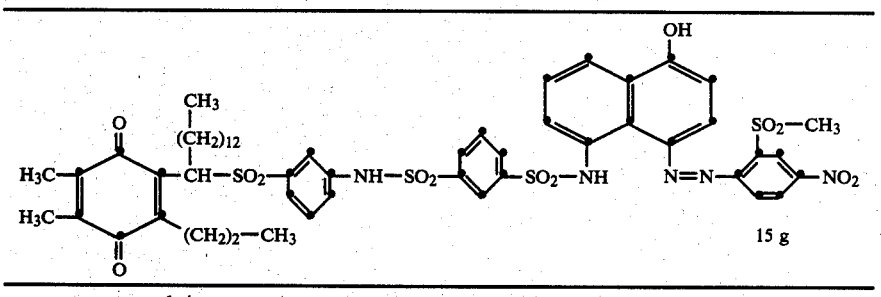

15 g

| | |
|---|---|
| gelatin | 225 g |
| 10% aqueous solution of MARLON A-396 (trade name) | 15 ml |
| distilled water up to | 300 g |

Exposure and processing

A strip A of the obtained photographic material was exposed through a yellow light-transmitting filter covered with a grey wedge having a constant 0.1. A strip B was exposed through a green light-transmitting filter covered with said grey wedge and a strip C was exposed through a red light-transmitting filter covered with said grey wedge. An unexposed strip of said photographic material was used to produce a black print by simultaneous transfer of yellow, magenta and cyan dye.

The unexposed and exposed strips were processed in contact with a receptor material (composition as described hereinafter) in the COPYPROOF CP 38 (trade name) diffusion transfer processing apparatus containing in its tray an aqueous solution comprising per liter:

| | |
|---|---|
| a compound as defined hereinafter in Table 1 | 80 ml |
| sodium hydroxide | 25 g |
| sodium orthophosphate | 15 g |
| sodium thiosulphate | 5 g |
| potassium bromide | 1 g |
| 1% ethanolic solution of 1-phenyl-2-tetrazoline-5-thione | 5 ml |
| paraformaldehyde | 2 g |
| gelatin | 5 g |
| triphenyl-n-hexadecylphosphonium bromide | 2 g |

Measurements

The blue, green and red absorption values of the black, yellow, green and red coloured receptor material strips, obtained by processing with the above aqueous solution modified as indicated in Table I, were measured behind Kodak Wratten filters Blue No. 47, Green No. 58 and Red No. 25 with a Macbeth (trade name) densitometer RD-100 R.

The above Wratten filters manufactured by the Eastman Kodak Company have a percent transmittance as represented in Handbook of Chemistry and Physics, 56th Edition, Editor Robert C. Weast-CRC Press 18901 Cranwood Parkway, Cleveland, Ohio 44128 p. E-241 and E-240.

TABLE I

| Added compound | none | A | B | C | D | E |
|---|---|---|---|---|---|---|
| relative density of black image behind filter: | | | | | | |
| blue | 84 | 122 | 40 | 78 | 73 | 47 |

TABLE I-continued

| Added compound | none | A | B | C | D | E |
|---|---|---|---|---|---|---|
| green | 119 | 143 | 56 | 116 | 110 | 69 |
| red | 133 | 153 | 64 | 126 | 98 | 66 |
| relative density of yellow image behind filter: | | | | | | |
| blue | 26 | 69 | 15 | 19 | 18 | 15 |
| relative density of green image behind filter: | | | | | | |
| blue | 28 | 72 | 21 | 23 | 26 | 20 |
| green | 33 | 46 | 28 | 29 | 34 | 27 |
| red | 97 | 126 | 66 | 80 | 95 | 67 |
| relative density of red image behind filter: | | | | | | |
| blue | 80 | 123 | 40 | 71 | 72 | 46 |
| green | 98 | 118 | 53 | 94 | 105 | 65 |
| red | 24 | 27 | 18 | 23 | 26 | 20 |

Compound A = triisopropanolamine
Compound B = triethanolamine
Compound C = ethylene glycol
Compound D = 2-amino-2-methyl-1-propanol
Compound E = 3-amino-1-propanol.

EXAMPLE 2

Example 1 was repeated with the difference, however, that 40 ml of compounds A, B, C, D and E was used instead of 80 ml.

The obtained blue, green and red absorption values of the black, yellow, green and red coloured receptor material strips are represented in Table II.

TABLE II

| Added compound | none | A | B | C | D | E |
|---|---|---|---|---|---|---|
| relative density of black image behind filter: | | | | | | |
| blue | 84 | 104 | 53 | 84 | 79 | 62 |
| green | 119 | 135 | 78 | 121 | 124 | 93 |
| red | 133 | 150 | 81 | 133 | 110 | 82 |
| relative density of yellow image behind filter: | | | | | | |
| blue | 26 | 47 | 14 | 23 | 19 | 14 |
| relative density of green image behind filter: | | | | | | |
| blue | 28 | 45 | 22 | 26 | 26 | 22 |
| green | 33 | 41 | 30 | 31 | 35 | 30 |
| red | 97 | 117 | 80 | 87 | 99 | 82 |
| relative density of red image behind filter | | | | | | |
| blue | 80 | 105 | 52 | 81 | 78 | 63 |
| green | 98 | 113 | 74 | 99 | 113 | 91 |
| red | 24 | 27 | 21 | 23 | 27 | 24 |

Preparation of compound M1 (compound VI)—First mode (a) 2-Acetyl-5-methyl-hydroquinone (VIa)

496 g (4 moles) of methylhydroquinone and 512 ml of acetic acid were heated at 80° C. with stirring. Boron trifluoride gas was bubbled through whereby the reaction temperature reached 120° C. Stirring was then continued and the reaction temperature kept at 120° C. for 1 h. Whilst vigorous stirring the reaction mixture was poured into 6 l of ice-water containing 1 kg of sodium acetate. Stirring was continued for 12 h whereupon the precipitate formed was filtered off, first washed by stirring in water containing some sodium carbonate and then with pure water, and finally dried. Purification proceeded by extraction with CLAIRSOL 300 (trade name). Yield: 400 g. Melting point: 144°–146° C.

(b)
2-Acetyl-4-p-hexadecyloxyphenyl-5-methyl-hydroquinone (VIb)

166 g (1 mole) of compound VIa were dissolved in 4 l of methylene chloride. Then 500 g of precipitated manganese(IV) dioxide and 500 g of sodium sulphate were added with stirring. The reaction mixture was refluxed with stirring for 90 min and filtered through a layer of sodium sulphate. To the filtrate 310 g (0.975 mole) of n-hexadecyloxybenzene were added and stirring was continued till complete dissolution. The solution was cooled just below 2° C. with stirring and 500 ml of trifluoro acetic acid were dropwise added such that the temperature did not rise above 5° C. After a further stirring period of 1 h, still 300 g of manganese(IV) dioxide were added. Stirring was continued for 2 h. The precipitate of manganese(IV) dioxide was separated by suction and the filtrate concentrated to 1 l in a rotary evaporator. The concentrated filtrate was diluted with 2.5 l of ethyl acetate and 2.5 l of water, and treated with 1 kg of sodium hydrosulphite.

After being stirred for 15 min the organic liquid layer was separated, washed first with 2.5 l of water containing 140 g of sodium hydrogen carbonate and subsequently twice with 2 l of 15% by weight aqueous sodium chloride solution and dried with sodium sulphate.

The solid product was obtained by evaporating the volatile solvent in a rotary evaporator. Recrystallization from 1.8 l of ethanol yielded 306 g of compound VIb.

Melting point: 68° C.

(c)
2-(1-Hydroxyethyl)-3-p-hexadecyloxyphenyl-5-methyl-hydroquinone (VIc)

96.5 g of compound VIb dissolved in 600 ml of anhydrous ethanol were reduced at 70°–75° C. under a hydrogen pressure of 105 kg/sq. cm in the presence of Raney-nickel for 3 h.

The catalyst was removed by filtering and the filtrate cooled in ice. The precipitate formed was suction-filtered, washed twice with cold ethanol and dried under reduced pressure. Yield: 81.6 g. Melting point: 75° C. (structure confirmed by NMR).

(d) Hydroquinone form of compound M1 (VId)

42.5 g of compound Q (prepared as hereinafter), 5 g of sodium acetate, 750 ml of acetic acid and 500 ml of water were dissolved at 60° C. forming solution A.

24.2 g of compound VIc were dissolved at 50° C. in 200 ml of acetic acid and added to solution A. The reaction mixture was stirred at 60° C. for 12 h. After cooling, the precipitate was filtered with suction, washed with a mixture of methanol/water (1:1 by volume) and dried. Yield: 47.5 g.

(e) Compound M1 (VI)

47.5 g of compound VId were dissolved at 60° C. in 550 ml of ethylene glycol monomethyl ether. Then 8 g of p-benzoquinone were added and the reaction mixture was stirred at 60° C. for 1 h. After cooling to 40° C. the reaction mixture was poured with stirring into 1.5 l of water whereto 10 ml of concentrated hydrochloric acid were added. The formed precipitate was suction-filtered, washed with a mixture of methanol/water (1:1 by volume) dried and purified by preparative column chromatography on silica gel by means of a mixture of methylene chloride/ethyl acetate (90/10) as the eluent.

Yield: 25 g. Melting point (unsharp): 100° C.

Preparation of compound M1—Second mode (f)

2-(1-p-aminophenylsulphonylethyl)-3-p-hexadecyloxyphenyl-5-methyl-benzoquinone (VIf)

51 g of p-aminobenzene-sulphinic acid and 121 g of compound VIc were stirred at 60° C. in a mixture of 1500 ml of acetic acid and 150 ml of water. To the mixture 15 ml of concentrated sulphuric acid were added at 60° C. and stirring was continued for 15 min. Oxidation of the hydroquinone proceeded by adding 230 ml of an aqueous iron(III)chloride solution (3.5 moles per liter) and stirring at 60° C. for 1 h. Thereupon 1500 ml of water were added to the reaction mixture at room temperature, and the precipitate was separated by suction-filtering and washed with water.

After recrystallization from benzine 64 g of compound VIf were obtained. Melting point: 124° C.

(g) Compound M1

12.4 g of compound VIf and 9.9 g of compound Vb (prepared as hereinafter) were stirred at 20° C. in a mixture of 150 ml of methylene chloride and 3 ml of pyridine for 90 min.

The formed precipitate was separated by suction-filtering and washed with methylene chloride. The filtrates were concentrated to dryness and the residue purified by preparative column chromatography under pressure on silicagel as the adsorbent and by means of a mixture of methylene chloride/ethyl acetate (85/15 by volume) as an eluent. Yield: 5.4 g.

Preparation of compound Y1 (compound VII)

(a) Hydroquinone form of compound Y1 (VIIa)

208 g of compound 1*e* prepared as described in the published European patent publication 0.004.399, 20 g of sodium acetate, 1.7 l of acetic acid and 1 l of water were stirred at 60° C. To the obtained mixture 96.8 g of compound VIc dissolved at 50° C. in 600 ml of acetic acid were added. The reaction mixture was kept at 60° C. for 6 h. Thereupon the reaction mixture was cooled and the formed precipitate was suction-filtered, washed with a mixture of methanol/water 1:1 by volume and dried.

Crystallization proceeded by dissolving the product at 80° C. in 1 l of ethylene glycol monomethyl ether, hot filtering and heating again to 80° C. After the addition of 100 ml of water and stirring, the mixture was cooled. The obtained precipitate was suction-filtered and washed with methanol. Yield: 98.5 g. Melting point: 138° C.

(b) Compound Y1 (VII)

98.5 g of compound VIIa were dissolved in 1 l of ethylene glycol monomethyl ether and 15 g of p-benzoquinone were added at 60° C. The reaction mixture was stirred at 60° C. for 1 h and cooled to 30° C. The precipitate formed was suction-filtered, washed with a mixture of methanol/water 1:1 by volume and dried.

Yield: 92.5 g. Melting point: 139° C.

Preparation of compounds P and Q (a)

1-methylsulphonylamino-4-(2-cyanophenyl)-azo)-7-sulphonaphthalene

To 600 ml of pyridine 223 g (1 mole) of 1-amino-7-sulpho-naphthalene were added. Then 92.8 ml (1.2 mole) of methylsulphonyl chloride were dropwise added with stirring and the temperature was allowed to rise to 60° C. Stirring was continued for 30 min and the reaction mixture poured into a mixture of 2 kg of ice and water to reach a temperature of 5° C., which temperature was suited for effecting diazotisation.

Diazotisation of o-aminobenzonitrile: 130 g (1.1 mole) of o-aminobenzonitrile were dissolved in 2 l of water whereto 275 ml of concentrated hydrochloric acid were added at 50° C. This solution was cooled to 0° C. Diazotation was effected by dropwise addition of a solution of 79.35 g (1.15 mole) of sodium nitrite dissolved in 200 ml of water at 0° C. The reaction mixture was stirred at 0° C. for 30 min.

The azo-coupling proceeded at 5° C. by adding the diazonium salt solution with stirring to the solution of 1-methylsulphonylamino-7-sulpho-naphthalene in pyridine. Stirring was continued and 400 l of concentrated hydrochloric acid were added.

The precipitate was suction-filtered, washed trice each time with 500 ml of 10% by weight aqueous sodium chloride solution and dried. Yield: 395 g (sodium chloride content: 25% by weight).

(b)

1-Methylsulphonylamino-4-(2-cyanophenylazo)-7-chlorosulphonyl-naphthalene (compound P)

430 g of the reaction product Va were stirred in 2 l of 1,2-dichloroethane and heated to remove the residual water. The mixture was cooled to 40° C. whereupon 100 ml of N-methylpyrrolidinone were added. Then 300 ml of phosphorous oxychloride were added dropwise till the temperature reached 50° C. Stirring was continued at 50° C. for 2 h. After cooling overnight, the precipitate was suction-filtered and washed trice each time with 300 ml of methylene chloride. After drying, the precipitate was stirred in 2 l of water, separated again and dried. Yield: 163 g.

(c)

1-methylsulphonylamino-4(2-cyano-phenylazo)-7-(p-sulphino-phenylsulphamyl)-naphthalene (compound Q)

To a solution of 52.5 g of p-aminobenzene sulphinic acid and 96 g of potassium carbonate in 850 ml of water first 1 l of acetone was added and then portionwise 157 g of compound P with stirring. Thereupon, the mixture was stirred for 1 h, poured into 2.5 l of water and acidified with 100 ml of concentrated hydrochloric acid. The precipitate formed was sucked off, washed with methanol and dried. Yield: 160 g.

We claim:

1. A process for the production of (a) dye image(s) by dye diffusion transfer comprising the steps of:

(1) image-wise photo-exposing a photographic colour material, which contains at least one alkali-permeable silver halide hydrophilic colloid layer which contains in operative contact therewith or therein a non-diffusing dye or dye precursor compound that when contacted with an aqueous alkaline liquid remains immobile in an alkali-permeable colloid layer of said material and is capable of being reduced by a silver halide developing agent at a rate slower than the reduction of image-wise developable silver halide of said silver halide hydrophilic colloid layer and in reduced state under alkaline conditions is capable of releasing a diffusible dye or dye precursor moiety, and (2) applying an aqueous alkaline liquid to said photo-exposed material effecting development in the presence of a developing agent and effecting with said liquid diffusion-transfer of said diffusible dye or dye precursor moiety to a receiving layer, characterized in that said liquid contains triisopropanolamine.

2. A process according to claim 1, characterized in that the non-diffusing dye or dye precursor compound is a ballasted compound capable of undergoing an electron-accepting nucleophilic displacement reaction separating hereby in alkaline medium a diffusible dye or dye precursor moiety.

3. A process according to claim 1, characterized in that the non-diffusing dye or dye precursor compound is a ballasted compound capable of being split by reduction under alkaline conditions into a ballasted quinonemethide compound and a diffusible dye or dye precursor moiety.

4. A process according to claim 1, characterized in that the process is carried out with a mixture of reducing agents consisting of electron donors and electron-transfer agents the latter being better silver halide reducing agents under the applied conditions of processing than the electron donors and wherein the electron transfer agents function to develop the silver halide and provide a corresponding image-wise pattern of oxidised electron donor compounds which compounds in unoxidised form are capable of reducing said non-diffusible dye or dye precursor compound.

5. A process according to claim 4, characterized in that said electron transfer agent is used as developing agent in diffusible state in the photographic material in (a) hydrophilic colloid layer(s) adjacent to one or more silver halide emulsion layers.

6. A process according to claim 4, characterized in that said electron donor is used in non-diffusible state in each silver halide emulsion layer containing said different non-diffusing dye or dye precursor compound.

7. A process according to claim 4, characterized in that the electron transfer agent is a 3-pyrazolidinone compound.

8. A process according to claim 6, characterized in that the electron donor is ascorbyl palmitate.

9. A process according to claim 4, characterized in that the electron donor compound is used in the photographic material in a molar range of 1:2 to 4:1 with respect to the non-diffusing dye or dye precursor compound and the electron transfer agent is applied in the same molar range.

10. A process according to claim 1, characterized in that the photographic multicolour material comprises a support, which is coated in successive order with (1) a red-sensitive silver halide emulsion layer containing a non-diffusing electron donor compound and a non-diffusing dye compound comprising a diffusible moiety providing a cyan image dye, (2) a hydrophilic colloid interlayer containing a diffusible electron transfer compound, (3) a green-sensitive silver halide emulsion layer containing a non-diffusing electron donor compound, and a non-diffusing dye compound comprising a diffusible moiety providing a magenta image dye, (4) a hydrophilic colloid interlayer containing a diffusible electron transfer compound, (5) a blue-sensitive silver halide emulsion layer containing a non-diffusing electron donor compound and a non-diffusing dye compound comprising a diffusible moiety providing a yellow image dye, and (6) a protective hydrophilic colloid layer, containing a diffusible electron transfer compound.

11. A process according to claim 1, characterized in that a silver halide solvent is contained in said aqueous alkaline liquid.

* * * * *